US008991967B2

(12) United States Patent
Tokushima

(10) Patent No.: US 8,991,967 B2
(45) Date of Patent: Mar. 31, 2015

(54) IMAGE FORMING APPARATUS, METHOD OF CONTROLLING TENSION OF RECORDING MEDIUM

(71) Applicant: Seiko Epson Corporation, Tokyo (JP)

(72) Inventor: Daiki Tokushima, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/211,154

(22) Filed: Mar. 14, 2014

(65) Prior Publication Data

US 2014/0285562 A1 Sep. 25, 2014

(51) Int. Cl.

| | |
|---|---|
| ***B41J 29/393*** | (2006.01) |
| ***B41J 15/16*** | (2006.01) |
| ***B41J 11/00*** | (2006.01) |
| ***B41J 15/04*** | (2006.01) |

(52) U.S. Cl.

CPC *B41J 15/16* (2013.01); *B41J 11/00* (2013.01); *B41J 15/042* (2013.01)

USPC ..... 347/16; 347/19

(58) Field of Classification Search

CPC ..... B41J 15/16; B41J 15/042; B41J 11/00

See application file for complete search history.

(56) References Cited

U.S. PATENT DOCUMENTS

2014/0285561 A1* 9/2014 Oba ..... 347/16

FOREIGN PATENT DOCUMENTS

JP 10-086472 4/1998

* cited by examiner

*Primary Examiner* — Julian Huffman

(74) *Attorney, Agent, or Firm* — Workman Nydegger

(57) ABSTRACT

An image forming apparatus includes a first roller and a second roller on which a recording medium is stretched; a head which performs image forming on the recording medium in an image forming region between the first roller and the second roller; an opening-shutting door which is provided in an external member; an opening-shutting regulation unit which regulates an opening operation of the opening-shutting door; and a control unit which transports the recording medium while applying a tension to the recording medium in the image forming region by controlling rotations of the first and second rollers, and regulates the opening operation of the opening-shutting door by the opening-shutting regulation unit while the head is performing the image forming, in which the control unit releases a regulation of the opening operation of the opening-shutting door by the opening-shutting regulation unit after performing a preparation operation for releasing the regulation which stops the recording medium in a state in which the tension is applied to the recording medium in the image forming region by controlling the rotations of the first and second rollers.

8 Claims, 5 Drawing Sheets

IMAGE FORMING APPARATUS, METHOD OF CONTROLLING TENSION OF RECORDING MEDIUM

BACKGROUND

1. Technical Field

The present invention relates to a tension control of a recording medium in an image forming apparatus which performs image forming on a recording medium, and particularly to a tension control of a recording medium when opening or shutting an opening-shutting door provided in an external member which is included in the image forming apparatus.

2. Related Art

A recording apparatus in JP-A-10-086472 performs image forming using a printing unit with respect to continuous paper which is located in a region between two transport rollers while transporting the continuous paper by rotating the two transport rollers which wind up the continuous paper. In particular, the recording apparatus is configured so that tension is applied to the continuous paper which is located in the region between the two transport rollers, and appropriate image forming is performed with respect to the continuous paper in a state of no sagging in the continuous paper.

Meanwhile, in such an image forming apparatus, it is possible to increase efficiency of various works which are executed by a worker with respect to the image forming apparatus by providing an opening-shutting door in an external member. That is, if the opening-shutting door for opening or shutting a portion as a work target is provided, it is possible for a worker to easily access the portion as the work target by opening the opening-shutting door, and to efficiently perform the work. At this time, it is preferable that transporting of a recording medium be stopped while the worker is working, for more efficient working. Therefore, a configuration of stopping a transportation of the recording medium by stopping an operation relating to the transportation of the recording medium (rotating of transport rollers, or the like, in example in JP-A-10-086472) when the worker opens the opening-shutting door is taken into consideration.

However, the operation relating to the transportation of the recording medium also contributes to applying of tension to the recording medium. For this reason, when the operation is stopped, the tension of the recording medium is released in an image forming region in which image forming is executed (region between two transport rollers in example in JP-A-10-086472), and as a result, there has been a concern that the following problems may occur. That is, in the configuration, there has been a case in which the recording medium in the image forming region which is loosened by not having tension applied causes a position deviation during the work of the worker. As a result, there has been a concern that, for example, image forming may not be appropriately performed, or the recording medium may be uselessly consumed due to the recording medium which is shifted with respect to a position at which image forming is restarted after completing the work of the worker.

SUMMARY

An advantage of some aspects of the invention is to provide a technology which can suppress a position deviation of a recording medium in an image forming region during a work of a worker by opening an opening-shutting door of an image forming apparatus, in the image forming apparatus which performs image forming on the recording medium in the image forming region while transporting the recording medium.

According to an aspect of the invention, there is provided an image forming apparatus which includes a first roller; a second roller on which a recording medium is stretched between the first roller and the second roller; a head which performs image forming on the recording medium in an image forming region between the first roller and the second roller; an external member which covers an inside of the apparatus; an opening-shutting door which is provided in the external member; an opening-shutting regulation unit which regulates an opening operation of the opening-shutting door; and a control unit which transports the recording medium while applying a tension to the recording medium in the image forming region by controlling rotations of the first and second rollers, and regulates the opening operation of the opening-shutting door by the opening-shutting regulation unit while the head is performing the image forming, in which the control unit releases a regulation of the opening operation of the opening-shutting door by the opening-shutting regulation unit after performing a preparation operation for releasing the regulation which stops the recording medium in a state in which the tension is applied to the recording medium in the image forming region by controlling the rotations of the first and second rollers.

According to another aspect of the invention, there is provided a method of controlling a tension of a recording medium in an image forming apparatus which performs image forming on a recording medium in an image forming region, and includes an opening-shutting door in an external member, the method including transporting the recording medium while applying a tension to the recording medium in the image forming region, and regulating an opening operation of the opening-shutting door while the image forming is performed; and releasing the regulation of the opening operation of the opening-shutting door, after performing a preparation operation for releasing the regulation which stops the recording medium in a state in which the tension is applied to the recording medium in the image forming region.

In such configurations of the aspects of the invention (image forming apparatus, and method of controlling tension of recording medium), the opening operation of the opening-shutting door which is provided in the external member of the image forming apparatus is regulated by the opening-shutting regulation unit. For this reason, a worker cannot open the opening-shutting door while the regulation of the opening operation by the opening-shutting regulation unit is performed, and can open the opening-shutting door while the regulation of the opening operation by the opening-shutting regulation unit is released. In addition, the release of the regulation of the opening operation of the opening-shutting door is performed after the preparation operation for releasing the regulation. Accordingly, when the opening-shutting door is opened by the worker, the preparation operation for releasing the regulation has been executed, and the recording medium is stopped in the image forming region in a state in which tension is applied thereto. As a result, it is possible to prevent a position deviation of the recording medium in the image forming region from occurring while the worker is working after the opening operation of the opening-shutting door. Incidentally, after performing the preparation operation for releasing the regulation means after completing the preparation operation for releasing the regulation, and also means the same time as the completing of the preparation operation for releasing the regulation.

The image forming apparatus may further include a rotational shaft which supplies the recording medium to the image forming region, or collects the recording medium from the image forming region by rotating, while detachably supporting the recording medium may be further included, in which the opening-shutting door may be provided so as to face the rotational shaft. That is, it is possible to suppress occurrence of a position deviation of the recording medium in the image forming region which occurs along with a work such as an exchange of the recording medium with respect to the rotational shaft.

In the image forming apparatus, the control unit may release the regulation of the opening operation of the opening-shutting door by the opening-shutting regulation unit after releasing the tension of the recording medium which is supported by the rotational shaft. With such a configuration, since the tension of the recording medium which is a work target is already released when a worker executes a work such as exchanging of the recording medium, or the like, by opening the opening-shutting door, it is possible for the worker to perform the work smoothly. Incidentally, after releasing the tension means after completing the releasing of the tension, and also means the same time as the completing of the releasing of the tension.

The image forming apparatus may further include a motor which drives the rotational shaft, in which the control unit may release the tension in the recording medium which is supported by the rotational shaft by stopping a transmission of power to the rotational shaft from the motor. With such a configuration, it is possible to simply release the tension of the recording medium which is supported by the rotational shaft by stopping the transmission of power to the rotational shaft from the motor.

The image forming apparatus may further include an opening-shutting detection unit which detects opening or shutting of the opening-shutting door, in which the control unit may regulate the opening operation of the opening-shutting door by the opening-shutting regulation unit after confirming a shut state of the opening-shutting door based on a detection result of the opening-shutting detection unit. In this manner, it is possible to avoid a situation in which the opening operation of the opening-shutting door is regulated before shutting the opening-shutting door, and to appropriately regulate the opening operation of the opening-shutting door after shutting the opening-shutting door.

In the image forming apparatus, the control unit may apply the tension to the recording medium which is supported by the rotational shaft, after regulating the opening operation of the opening-shutting door by the opening-shutting regulation unit. With such a configuration, it is possible to avoid a situation in which tension is applied to the recording medium which is supported by the rotational shaft by mistake during executing of a work by a worker, and the work of the worker is disturbed.

Incidentally, after regulating the opening operation means after completing the regulation of the opening operation, and also means the same time as the completing of the regulation of the opening operation.

The image forming apparatus may further include an input unit which receives an input from a worker, in which the control unit may release the regulation of the opening operation of the opening-shutting door by the opening-shutting regulation unit after performing the preparation operation for releasing the regulation, when there is an input denoting that a work accompanied by the opening operation of the opening-shutting door is to be executed, in the input unit. It is possible to release the regulation of the opening operation of the opening-shutting door by performing the preparation operation for releasing the regulation at a timing corresponding to an execution of a work by a worker.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
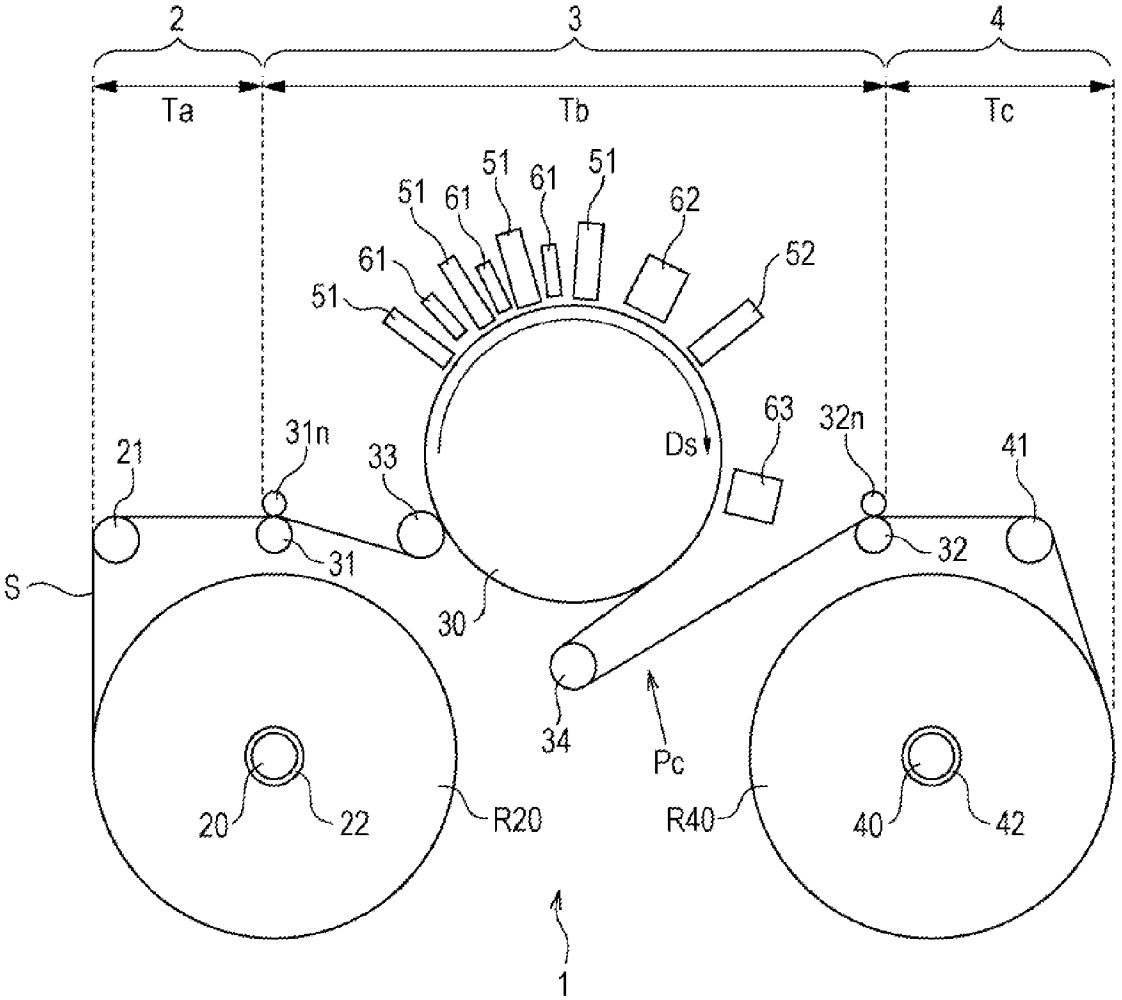
FIG. 1 is a front view which illustrates an internal configuration of a printer to which the invention can be applied.

FIG. 1 is a front view which schematically illustrates an example of an internal configuration of a printer to which the invention can be applied. As illustrated in FIG. 1, in a printer 1, one sheet S (web) of which both ends are wound in a roll shape around a feeding shaft 20 and a winding shaft 40 is stretched between the feeding shaft 20 and the winding shaft 40, and the sheet S is transported to the winding shaft 40 from the feeding shaft 20 along a transport path Pc which stretches in this manner. In other words, a feed roll R20 and a windup roll R40 are formed when the both ends of the sheet S in the transport path Pc are wound in a roll shape, respectively, and the sheet S is transported using a roll to roll method from the feed roll R20 which is pivotally supported by the feeding shaft 20 to the windup roll R40 which is pivotally supported by the winding shaft 40.

In addition, in the printer 1, an image is recorded with respect to the sheet S which is transported along the transport path Pc. A type of the sheet S is largely classified into paper types and film types. As a specific example, there is fine quality paper, cast coated paper, art paper, coated paper, or the like, for the paper types, and there is synthetic paper, Polyethylene terephthalate (PET), polypropylene (PP), or the like, for the film types. Schematically, the printer 1 includes a feeding unit 2 (feeding region) which feeds the sheet S from the feeding shaft 20, a process unit 3 (process region) which records an image on the sheet S which is fed from the feeding unit 2, and a winding unit 4 (winding region) which winds the sheet S on which an image is recorded in the process unit 3 around the winding shaft 40. In addition, in the following descriptions, a surface on which an image is recorded is referred to as the front surface, and on the other hand, a surface which is opposite to the front surface is referred to as the rear surface, regarding both surfaces of the sheet S.

The feeding unit 2 includes the feeding shaft 20 which winds an end of the sheet S, and a driven roller 21 which winds up the sheet S which is drawn out from the feeding shaft 20. The feeding shaft 20 supports the end of the sheet S by winding the sheet in a state in which the front surface of the sheet S is caused to face the outside. In addition, when the feeding shaft 20 rotates clockwise as illustrated in FIG. 1, the sheet S which is wound around the feeding shaft 20 is fed to the process unit 3 via the driven roller 21. Incidentally, the sheet S is wound around the feeding shaft 20 through a core tube 22 which is detachable from the feeding shaft 20.

Accordingly, when the sheet S of the feeding shaft 20 is used up, it is possible to exchange the sheet S of the feeding shaft 20 by mounting a new core tube 22 on which a roll shaped sheet S (feed roll R20) is wound on the feeding shaft 20.

The process unit 3 performs recording of an image on the sheet S by appropriately performing processes using each of functional units 51, 52, 61, 62, and 63 which are arranged along the outer peripheral surface of a platen drum 30 while supporting the sheet S which is fed from the feeding unit 2 on the platen drum 30. The process unit 3 is provided with a front driving roller 31 and a rear driving roller 32 on both sides of the platen drum 30, and the sheet S which is transported from the front driving roller 31 to the rear driving roller 32 is supported by the platen drum 30, and has an image recorded thereon.

The front driving roller 31 includes a plurality of minute protrusions which are formed using thermal spraying on the outer peripheral surface, and winds up the sheet S which is fed from the feeding unit 2 from the rear surface side. In addition, the front driving roller 31 transports the sheet S which is fed from the feeding unit 2 to the downstream side of a transport path Pc by rotating clockwise as illustrated in FIG. 1. In addition, a nip roller 31*n* is provided with respect to the front driving roller 31. The nip roller 31*n* comes into contact with the front surface of the sheet S in a state of being urged to the front driving roller 31 side, and interposes the sheet S between the nip roller and the front driving roller 31. In this manner, a friction force between the front driving roller 31 and the sheet S is secured, and it is possible to reliably transport the sheet S using the front driving roller 31.

The platen drum 30 is a cylindrical drum of which a diameter is 400 mm, for example, is rotatably supported by a not shown support mechanism, and winds up the sheet S which is transported from the front driving roller 31 to the rear driving roller 32 from the rear surface side. The platen drum 30 supports the sheet S from the rear surface side while rotating in the transport direction Ds of the sheet S in a driven manner by receiving a friction force between the platen drum and the sheet S. Incidentally, the process unit 3 is provided with driven rollers 33 and 34 which replicate the sheet S on both sides of a winding portion with respect to the platen drum 30. The driven roller 33 in the driven rollers replicates the sheet S by winding up the front surface of the sheet S between the front driving roller 31 and the platen drum 30. On the other hand, the driven roller 34 replicates the sheet S by winding up the front surface of the sheet S between the platen drum 30 and the rear driving roller 32. In this manner, it is possible to secure a long winding portion of the sheet S with respect to the platen drum 30 by replicating the sheet S on the respective upstream side and downstream side in the transport direction Ds with respect to the platen drum 30.

The rear driving roller 32 includes a plurality of minute protrusions which are formed using thermal spraying on the outer peripheral surface, and winds up the sheet S which is transported from the platen drum 30 through the driven roller 34 from the rear surface side. In addition, the rear driving roller 32 transports the sheet S to the winding unit 4 by rotating clockwise as illustrated in FIG. 1. In addition, a nip roller 32*n* is provided with respect to the rear driving roller 32. The nip roller 32*n* comes into contact with the front surface of the sheet S in a state of being urged to the rear driving roller 32 side, and interposes the sheet S between the nip roller and the rear driving roller 32. In this manner, a friction force between the rear driving roller 32 and the sheet S is secured, and it is possible to reliably transport the sheet S using the rear driving roller 32.

In this manner, the sheet S which is transported from the front driving roller 31 to the rear driving roller 32 is supported by the outer peripheral surface of the platen drum 30. In addition, the process unit 3 is provided with a plurality of recording heads 51 corresponding to colors which are different from each other in order to record a color image on the front surface of the sheet S which is supported by the platen drum 30. Specifically, four recording heads 51 corresponding to a yellow color, a cyan color, a magenta color, and a black color are aligned in the transport direction Ds in this order of the colors. Each recording head 51 faces the front surface of the sheet S which is wound around the platen drum 30 with a little clearance, and ejects ink (color ink) of a corresponding color from nozzles in an ink jet method. In addition, a color image is formed on the front surface of the sheet S when each recording head 51 ejects ink on the sheet S which is transported in the transport direction Ds.

Incidentally, Ultraviolet (UV) ink (photocurable ink) which is cured by being irradiated with ultraviolet rays (light) is used as ink. Therefore, UV irradiators 61 and 62 (light irradiation unit) are provided in the process unit 3 in order to fix ink onto the sheet S by curing the ink. In addition, curing of the ink is executed in two stages of temporary curing and main curing. The UV irradiator 61 for temporary curing is arranged between each of the plurality of recording heads 51. That is, the UV irradiator 61 cures ink to an extent of not being collapsed in shape (temporary curing) by irradiating weak UV rays, and does not cure ink completely. On the other hand, the UV irradiator 62 for main curing is provided on the downstream side in the transport direction Ds with respect to the plurality of recording heads 51. That is, the UV irradiator 62 completely cures (main curing) ink by irradiating UV rays which are stronger than those of the UV irradiator 61.

In this manner, the UV irradiator 61 which is arranged between each of the plurality of recording heads 51 temporarily cures color ink which is ejected onto the sheet S from the recording head 51 on the upstream side in the transport direction Ds. Accordingly, ink which is ejected onto the sheet S from one recording head 51 is temporarily cured until reaching a recording head 51 which is neighboring to the one recording head 51 on the downstream side in the transport direction Ds. In this manner, it is possible to suppress occurrence of color mixing in which color inks of different colors are mixed. A color image is formed on the sheet S when the plurality of recording heads 51 eject ink of colors which are different from each other in a state of suppressing the color mixing in this manner. In addition, the UV irradiator 62 for main curing is provided on the further downstream side in the transport direction Ds than the plurality of recording heads 51. For this reason, the color image which is formed using the plurality of recording heads 51 is fixed onto the sheet S by being subject to main curing by the UV irradiator 62.

In addition, a recording head 52 is provided on the downstream side in the transport direction Ds with respect to the UV irradiator 62. The recording head 52 faces the front surface of the sheet S which is wound around the platen drum 30 with a little clearance, and ejects transparent UV ink onto the front surface of the sheet S from nozzles in an ink jet method. That is, the transparent ink is further ejected onto the color image which is formed using the recording heads 51 of four colors. The transparent ink is ejected onto the entire surface of the color image, and gives the color image texture such as glossiness, or a mat look. In addition, a UV irradiator 63 is provided on the downstream side in the transport direction Ds with respect to the recording head 52. The UV irradiator 63 completely cures (main curing) the transparent ink which is ejected from the recording head 52 by irradiating strong UV rays. In this manner, it is possible to fix the transparent ink onto the front surface of the sheet S.

In this manner, the color image which is coated with the transparent ink is formed on the sheet S which is wound around the outer peripheral portion of the platen drum 30 by appropriately performing ejecting and curing of ink in the process unit 3. In addition, the sheet S on which the color image is formed is transported to the winding unit 4 by the rear driving roller 32.

The winding unit 4 includes a driven roller 41 which winds up the sheet S from the rear surface side between the winding shaft 40 and the rear driving roller 32, in addition to the winding shaft 40. The winding shaft 40 supports an end of the sheet S by winding up in a state in which the front surface of the sheet S faces outside. That is, when the winding shaft 40 rotates clockwise as illustrated in FIG. 1, the sheet S which is transported from the rear driving roller 32 is wound around the winding shaft 40 through the driven roller 41. That is, the sheet S is wound around the winding shaft 40 through a core tube 42 which is detachable from the winding shaft 40. Accordingly, when the sheet S which is wound around the winding shaft 40 (windup roll R40) is full, it is possible to detach the sheet S together with the core tube 42.

Figure 2:
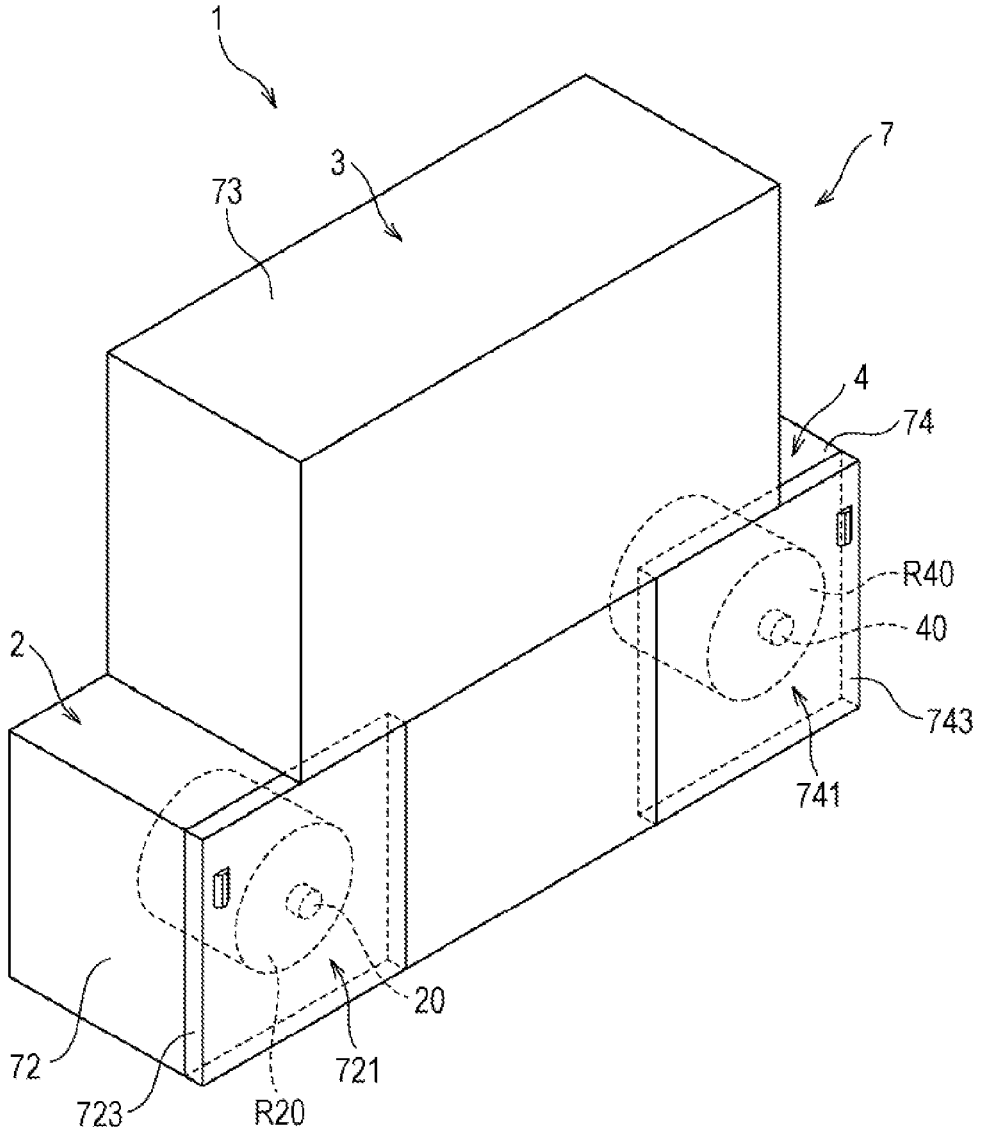
FIG. 2 is a perspective view which illustrates an external configuration of the printer illustrated in FIG. 1.

FIG. 2 is a perspective view which illustrates an example of an external configuration of the printer in FIG. 1. In FIG. 2, only the feeding shaft 20, the winding shaft 40, the feed roll R20, and the windup roll R40 are denoted by dotted lines in the internal configuration of the printer 1. As illustrated in FIG. 2, the printer 1 includes a housing member 7 (external member) which accommodates each unit illustrated in FIG. 1. The housing member 7 is configured of a feeding unit cover 72 which is provided on the left side in FIG. 2, and mainly covers the feeding unit 2, a process unit cover 73 which is provided in a center in FIG. 2, and mainly covers the process unit 3, and a winding unit cover 74 which is provided on the right side in FIG. 2, and mainly covers the winding unit 4.

The feeding unit cover 72 accommodates the feeding shaft 20 and the feed roll R20. An opening portion 721 opens on the front side of the feeding unit cover 72 by facing the feeding shaft 20 and the feed roll R20. In addition, a feeding unit door 723 which opens and shuts the opening portion 721 is provided on the front side of the feeding unit cover 72. Accordingly, when opening the feeding unit door 723, a worker can perform a work such as exchanging of the feed roll R20 with respect to the feeding shaft 20 by accessing the feeding unit 2. On the other hand, by shutting the feeding unit door 723, access to the feeding unit 2 by the worker can be prevented.

The winding unit cover 74 accommodates the winding shaft 40 and the windup roll R40. An opening portion 741 opens on the front side of the winding unit cover 74 by facing the winding shaft 40 and the windup roll R40. In addition, a winding unit door 743 which opens and shuts the opening portion 741 is provided on the front side of the winding unit cover 74. Accordingly, when opening the winding unit door 743, a worker can perform a work such as exchanging of the windup roll R40 with respect to the winding shaft 40 by accessing the winding unit 4. On the other hand, by shutting the winding unit door 743, access to the winding unit 4 by the worker can be prevented.

Figure 3:
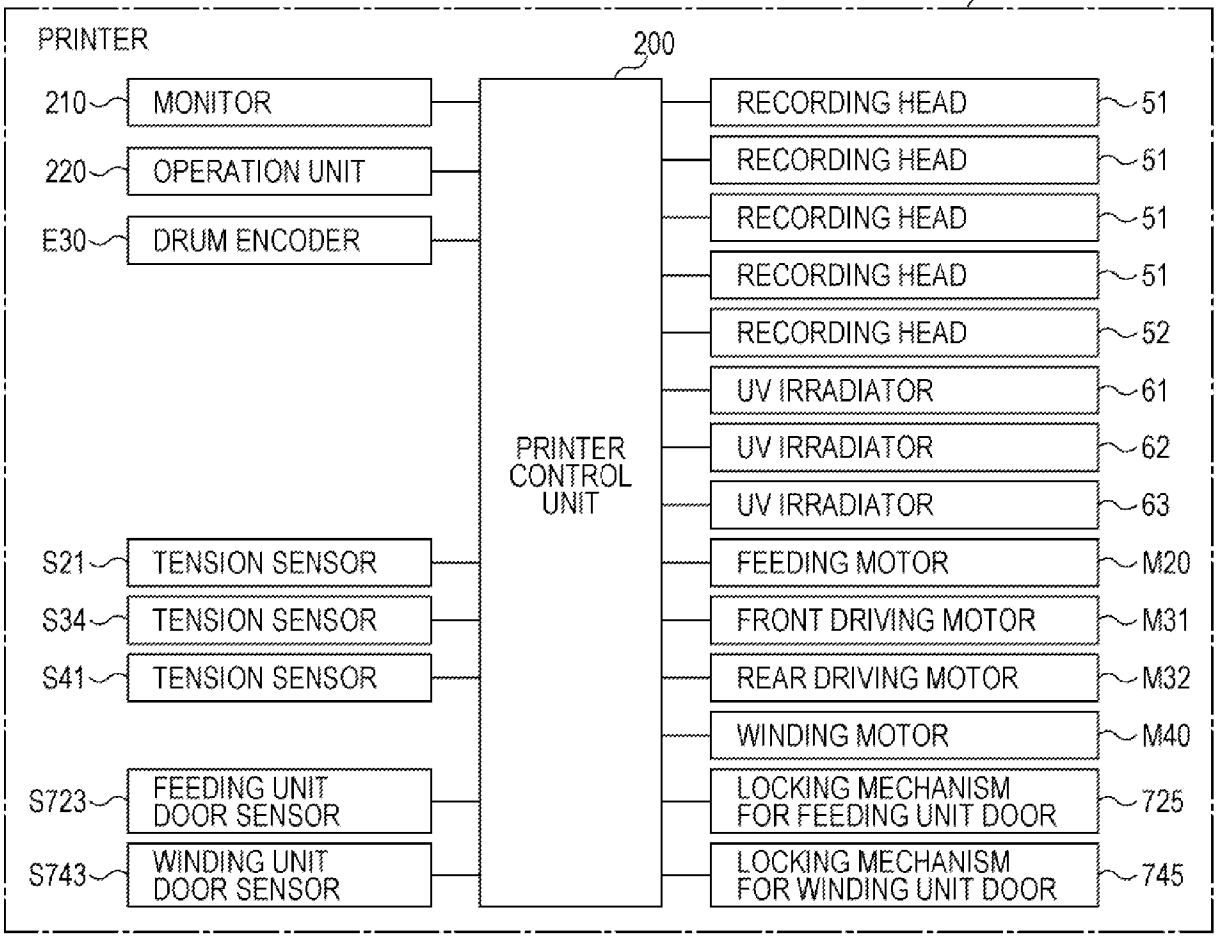
FIG. 3 is a block diagram which illustrates an electrical configuration which controls the printer illustrated in FIG. 1.

Hitherto, a schematic device configuration of the printer 1 has been described. Subsequently, an electrical configuration for controlling the printer 1 will be described. FIG. 3 is a block diagram which schematically illustrates an electrical configuration for controlling the printer in FIG. 1. As illustrated in FIG. 3, a printer control unit 200 which controls each unit of the printer 1 is provided in the printer 1. Specifically, the printer control unit 200 is a computer which is configured of a Central Processing Unit (CPU), or a memory.

The printer 1 is provided with a monitor 210 which is configured of a liquid crystal display, or the like, as an interface between a worker and the printer control unit 200, and an operation unit 220 which is configured of a keyboard, a mouse, or the like. A menu screen is displayed on the monitor 210, in addition to an image as a printing target. Accordingly, a worker can set various printing conditions such as a type of a printing medium, a size of the printing medium, and a printing quality by opening a printing setting screen from the menu screen, by operating the operation unit 220 while confirming on the monitor 210. In addition, the worker can also perform an input of instructing an execution of image forming, an input which informs of performing an exchanging work of the feed roll R20 or the windup roll R40, or the like, with respect to the printer control unit 200 through the monitor 210, or the operation unit 220. In addition, a specific configuration of the interface with the worker can be variously modified, and the operation unit 220 may be configured of a touch panel of the monitor 210, using a touch panel display as the monitor 210, for example. In addition, the printer control unit 200 controls each unit of the printer 1 as follows according to an input from the worker.

The printer control unit 200 controls an ink ejecting timing of each of the recording heads 51 which forms a color image according to a transport of the sheet S. Specifically, the control of the ink ejecting timing is performed based on an output of a drum encoder E30 (detection value) which is attached to a rotational shaft of the platen drum 30, and detects a rotating position of the platen drum 30. That is, since the platen drum 30 rotates along with the transport of the sheet S in a driven manner, it is possible to ascertain a transport position of the sheet S by referring to an output of the drum encoder E30 which detects a rotating position of the platen drum 30. Therefore, the printer control unit 200 forms a color image by causing ink which is ejected from each recording head 51 to be landed on a target position of the transported sheet S, by generating a print timing signal (pts) from the output of the drum encoder E30, and controlling an ink ejecting timing of each recording head 51 based on the pts signal.

In addition, also a timing of ejecting the transparent ink by the recording head 52 is controlled by the printer control unit 200 based on an output of the drum encoder E30, similarly. In this manner, it is possible to accurately eject the transparent ink with respect to a color image which is formed by the plurality of recording heads 51. In addition, a timing of ON-OFF of the UV irradiators 61, 62, and 63, or an irradiation light amount is also controlled by the printer control unit 200.

The printer control unit 200 also controls locking states of the feeding unit door 723 and the winding unit door 743 which are illustrated in FIG. 2. That is, a locking mechanism for feeding unit door 725 for executing locking and unlocking of the feeding unit door 723 is provided in the feeding unit cover 72. Accordingly, an operation of opening a shut feeding unit door 723 is prevented while the locking mechanism for feeding unit door 725 is locking the feeding unit door 723, and is possible only when the locking mechanism for feeding unit door 725 has unlocked the feeding unit door 723. In addition, locking and unlocking of the feeding unit door 723 can be performed when the printer control unit 200 controls the locking mechanism for feeding unit door 725. Similarly, a locking mechanism for winding unit door 745 for executing locking and unlocking of the winding unit door 743 is provided in the winding unit cover 74. Accordingly, an operation of opening a shut winding unit door 743 is prevented while the locking mechanism for winding unit door 745 is locking the winding unit door 743, and is possible only when the locking mechanism for winding unit door 745 has unlocked the winding unit door 743. In addition, locking and unlocking of the winding unit door 743 is performed when the printer control unit 200 controls the locking mechanism for winding unit door 745. In addition, either the locking mechanism for feeding unit door 725, or the locking mechanism for winding unit door 745 can be configured using an electromagnetic lock.

At this time, the printer control unit 200 can perform controls of the locking states of the feeding unit door 723 and the winding unit door 743 based on detection results of door sensors S723 and S743 which detect opening-shutting of each door 723 and 743. That is, a feeding unit door sensor S723 which detects opening-shutting of the feeding unit door 723 is provided in the feeding unit cover 72. In addition, the printer control unit 200 locks the feeding unit door 723 using the locking mechanism for feeding unit door 725, after confirming shutting of the feeding unit door 723 (shut state) based on a detection result of the feeding unit door sensor S723. In this manner, it is possible to avoid a situation of trying to lock the feeding unit door 723 in a state in which the feeding unit door 723 is open. In addition, similarly, a winding unit door sensor S743 which detects opening-shutting of the winding unit door 743 is provided in the winding unit cover 74. In addition, the printer control unit 200 locks the winding unit door 743 using the locking mechanism for winding unit door 745 after confirming shutting of the winding unit door 743 (shut state) based on a detection result of the winding unit door sensor S743. In this manner, it is possible to avoid a situation of trying to lock the winding unit door 743 in a state in which the winding unit door 743 is open.

In addition, the printer control unit 200 conducts a function of controlling the transport of the sheet S which is described in detail in FIG. 1. That is, a motor is connected to the respective feeding shaft 20, the front driving roller 31, the rear driving roller 32, and the winding shaft 40 among members which configure a sheet transport system. In addition, the printer control unit 200 controls the transport of the sheet S by controlling a speed or a torque of each motor while rotating these motors. The control of the transport of the sheet S will be described in detail below.

The printer control unit 200 supplies the sheet S from the feeding shaft 20 to the front driving roller 31 by rotating a feeding motor M20 which drives the feeding shaft 20. At this time, the printer control unit 200 controls a torque of the feeding motor M20, and adjusts a tension of the sheet S from the feeding shaft 20 to the front driving roller 31 (feeding tension Ta). That is, a tension sensor S21 which detects the feeding tension Ta is attached to the driven roller 21 which is arranged between the feeding shaft 20 and the front driving roller 31. The tension sensor S21 can be configured of, for example, a load cell which detects a power which is received from the sheet S. In addition, the printer control unit 200 performs a feedback control of the torque of the feeding motor M20 based on a detection result of the tension sensor S21, and adjusts the feeding tension Ta of the sheet S.

In addition, the printer control unit 200 rotates a front driving motor M31 which drives the front driving roller 31, and a rear driving motor M32 which drives the rear driving roller 32. In this manner, the sheet S which is fed from the feeding unit 2 passes through the process unit 3. At this time, a speed control is performed with respect to the front driving motor M31, and on the other hand, a torque control is performed with respect to the rear driving motor M32. That is, the printer control unit 200 constantly adjusts a rotating speed of the front driving motor M31 based on an encoder output of the front driving motor M31. In this manner, the sheet S is transported at a constant speed by the front driving roller 31.

On the other hand, the printer control unit 200 controls a torque of the rear driving motor M32, and adjusts a tension of the sheet S from the front driving roller 31 to the rear driving roller 32 (process tension Tb). That is, a tension sensor S34 which detects the process tension Tb is attached to a driven roller 34 which is arranged between the platen drum 30 and the rear driving roller 32. The tension sensor S34 can be configured of, for example, a load cell which detects a power which is received from the sheet S. In addition, the printer control unit 200 performs a feedback control of the torque of the rear driving motor M32 based on a detection result of the tension sensor S34, and adjusts the process tension Tb of the sheet S.

In addition, the printer control unit 200 rotates a winding motor M40 which drives the winding shaft 40, and winds the sheet S which is transported by the rear driving roller 32 around the winding shaft 40. At this time, the printer control unit 200 controls a torque of the winding motor M40, and adjusts a tension of the sheet S from the rear driving roller 32 to the winding shaft 40 (winding tension Tc). That is, a tension sensor S41 which detects the winding tension Tc is attached to the driven roller 41 which is arranged between the rear driving roller 32 and the winding shaft 40. The tension sensor S41 can be configured of, for example, a load cell which detects a power which is received from the sheet S. In addition, the printer control unit 200 performs a feedback control of the torque of the winding motor M40 based on a detection result of the tension sensor S41, and adjusts the winding tension Tc of the sheet S.

Figure 4:
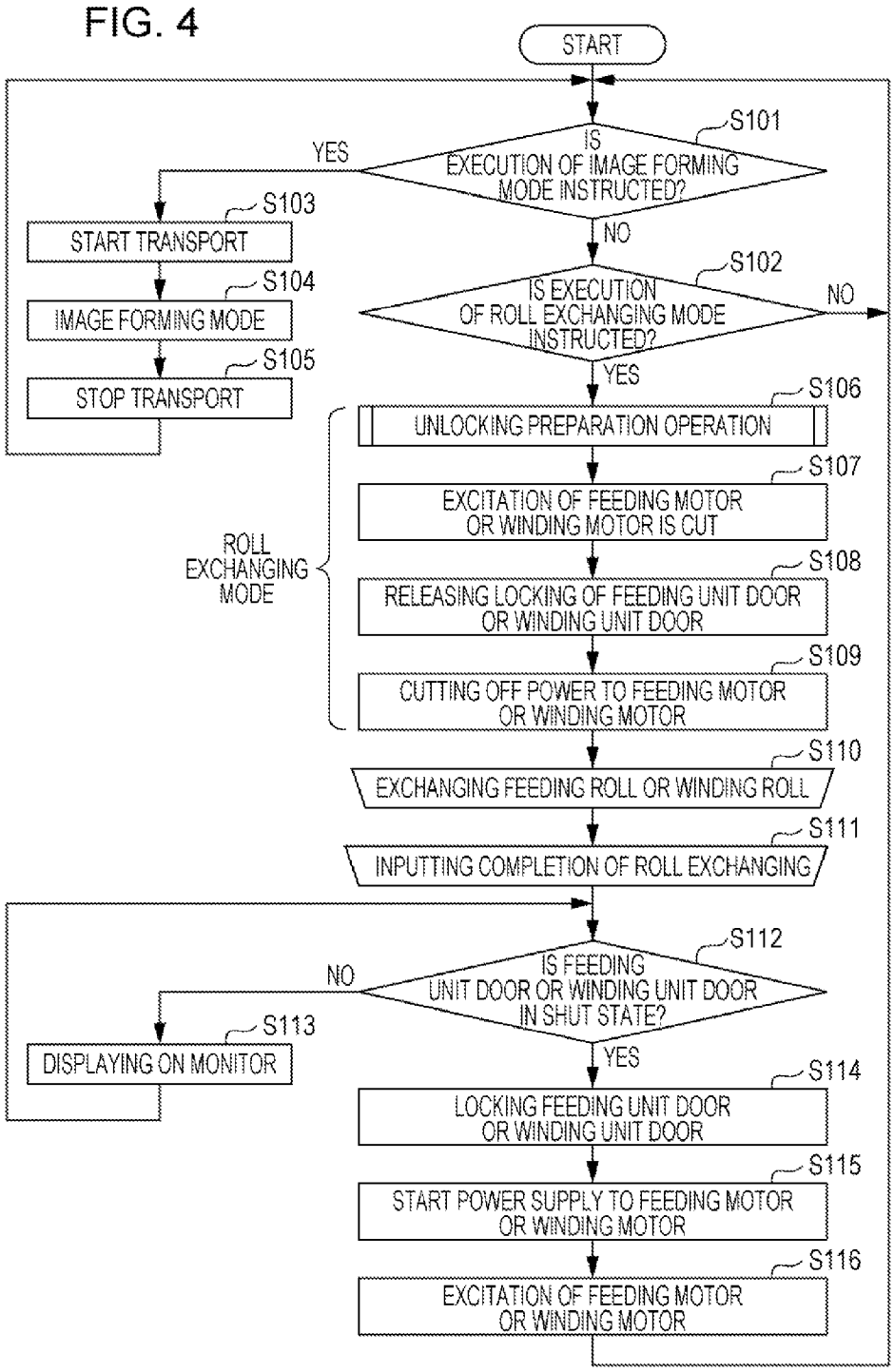
FIG. 4 is a flowchart which illustrates operations which can be executed in the printer illustrated in FIG. 1.

FIG. 4 is a flowchart which illustrates an example of operations which can be executed in the printer in FIG. 1, and specifically exemplifies a case in which the printer control unit 200 executes an image forming mode, or a roll exchanging mode from a standby state. That is, the printer control unit 200 confirms a presence or absence of an input denoting an instruction of executing an image forming mode, or an input denoting an instruction of executing a roll changing mode in the standby state (steps S101 and S102). In addition, when there is any input, the printer control unit 200 executes the mode. Incidentally, in the standby state, either the feeding unit door 723, or the winding unit door 743 is shut and locked.

In step S101, whether or not there is the input of instructing executing of the image forming mode from a worker through the monitor 210, or the operation unit 220 is confirmed. In addition, when there is the input of instructing executing of the image forming mode (Yes in step S101), steps S103 to S105 are sequentially executed. Specifically, in step S103, the transport of the sheet S is started. The transport of the sheet is executed while applying predetermined tensions Ta, Tb, and Tc to the sheet S in each of the feeding unit 2, the process unit 3, and the winding unit 4. In this manner, it is possible to stably transport the sheet S from the feeding shaft 20 to the winding shaft 40, and it is possible to securely support the sheet S using the platen drum 30 by causing the sheet S to come into close contact with the platen drum 30, in the process unit 3. As a result, it is possible to stably perform image forming on the sheet S.

When a speed of transporting the sheet S which is started in step S103 becomes stable at a predetermined transport speed for image forming, the image forming mode in step S104 is executed, and image forming is performed when the recording heads 51 and 52, and the UV irradiators 61 to 63 are operated using the above described manner. In addition, when the image forming mode in step S104 is completed, the transport of the sheet S is stopped in step S105. At this time, each tension Ta, Tb, and Tc which is applied to the sheet S after stopping is the same as each tension Ta, Tb, and Tc which is applied to the sheet S while executing the image forming mode. In this manner, when steps S103 to S105 are completed, the printer control unit 200 returns to a standby state (steps S101 and S102). In addition, both the feeding unit door 723 and the winding unit door 743 are shut and locked while executing steps S103 to S105.

In step S101, when it is determined that there is no input of instructing executing of the image forming mode (determining as No), the process proceeds to step S102, and whether or not there is an input of instructing executing of the roll changing mode from a worker through the monitor 210, or the operation unit 220 is confirmed. When there is no input of instructing executing of the roll changing mode (No in step S102), the printer control unit 200 returns to step S101, and is in a standby state.

On the other hand, when there is the input of instructing executing of the roll changing mode (Yes in step S102), the printer control unit 200 executes the roll changing mode in steps S106 to S109. That is, a worker can inform the printer control unit 200 of performing exchanging of the feed roll R20 or the windup roll R40 by performing the input. In addition, when the printer control unit 200 which received the information executes the roll changing mode, a preparation for exchanging the feed roll R20 or the windup roll R40 is completed.

Incidentally, a worker can instruct the roll exchange while specifying a roll to be exchanged between the feed roll R20 and the windup roll R40. With respect to this, a series of operations which is executed by receiving the instruction (steps S106 to S116) is basically the same even though operation targets are different between the roll R20 and the roll R40. Therefore, in the following descriptions, points when a worker informs of exchanging of the windup roll R40 will be described, after describing a case in which the worker informs of exchanging of the feed roll R20.

Figure 5:
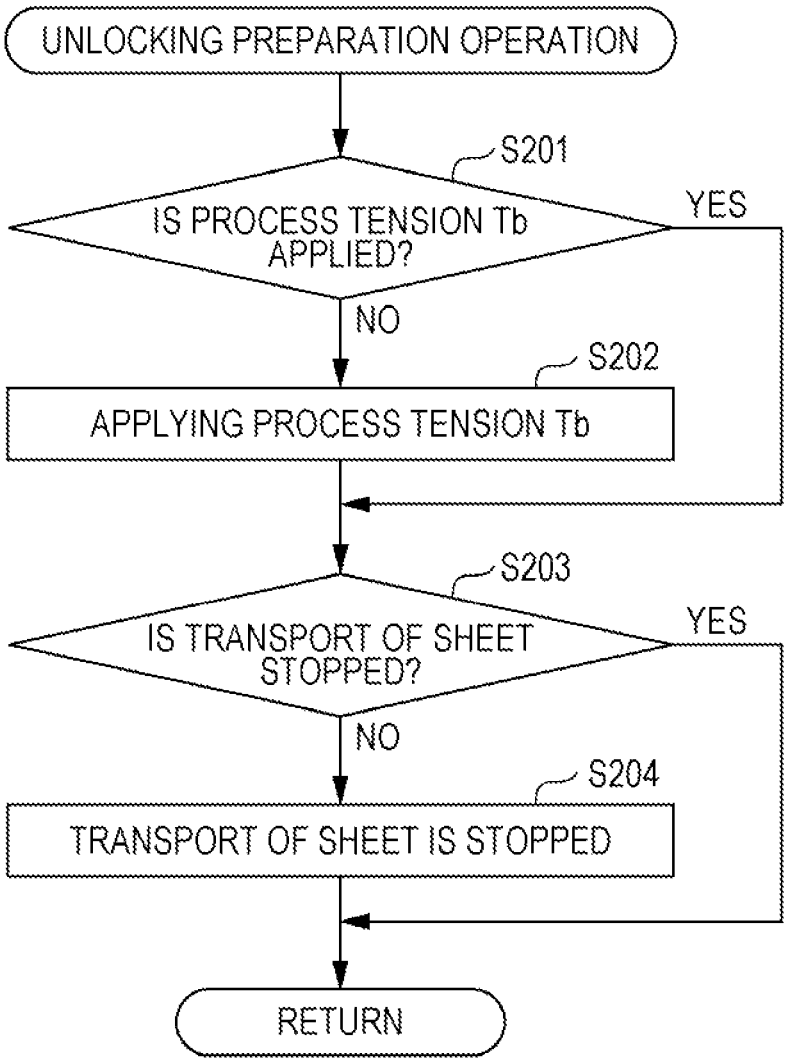
FIG. 5 is a flowchart which illustrates a specific example of unlocking preparation operations illustrated in FIG. 4.

In step S106, unlocking preparation operations are executed (FIG. 5). FIG. 5 is a flowchart which illustrates a specific example of the unlocking preparation operations which are illustrated in FIG. 4. In step S201, whether or not the process tension Tb is applied to the process unit 3 is determined. For example, when the process tension Tb of the process unit 3 is released for some reason, or the like, it is determined to be "No" in step S201. Accordingly, a torque of the rear driving roller 32 is controlled, and the process tension Tb is applied to the process unit 3 (Tb>0) in step S202.

On the other hand, when the process tension Tb is applied to the process unit 3, and it is determined to be "Yes" in step S201, step S202 is omitted, and the process proceeds to step S203. Incidentally, the process tension Tb in the unlocking preparation operation may be the same as, or may be different from the process tension Tb which is applied to the process unit 3 in the image forming mode, or in the standby state. In addition, it is not essential to adjust the process tension Tb to a specific value, and there may be a control in which "Yes" is determined in step S201 when the process tension Tb is equal to or greater than a predetermined threshold.

Whether or not the transport of the sheet S is stopped is determined in step S203. In addition, when the transport of the sheet S is executed for some reason, and it is determined to be "No" in step S203, for example, a rotation of each motor M20, M31, M32, and M40 is stopped in step S204, and the transport of the sheet is stopped. At this time, a torque to the rear driving roller 32 (in other words, torque of rear driving motor M32) is controlled so that the process tension Tb which is applied to the sheet S in the process unit 3 is maintained before and after stopping the transport of the sheet. On the other hand, when the transport of the sheet S is stopped, and it is determined to be "Yes" in step S203, step S203 is omitted. In addition, when the unlocking preparation operation in steps S201 to S204 is completed, the process returns to the flowchart in FIG. 4.

In step S107 in FIG. 4, excitation of the feeding motor M20 is cut. Due to this, a torque which is applied to the feeding shaft 20 by the feeding motor M20 is lost (becomes 0), and the feeding tension Ta is released (Ta=0). That is, the tension Ta of the sheet S which is supported by the feeding shaft 20 is easily released by stopping a transmission of a power to the feeding shaft 20 from the feeding motor M20. In addition, the process tension Tb at a time of completing the unlocking preparation operation is continuously applied to the sheet S in the process unit 3, even after releasing the feeding tension Ta.

In addition, in the subsequent step S108, locking of the feeding unit door 723 is released (that is, unlocked). At this time, steps S107 and S108 may be performed sequentially with a time gap, and may be performed at the same time. When the steps are performed at the same time, a configuration may be adopted in which a circuit which controls excitation of the feeding motor M20 and a circuit which controls the electromagnetic lock of the locking mechanism for feeding unit door 725 are linked, and when excitation of the feeding motor M20 is cut, the locking mechanism for feeding unit door 725 is released at the same time. In addition, a power supply to the feeding motor M20 is cut off in step S109, and the roll exchanging mode in steps S106 to S109 are completed. When the roll exchanging mode is completed in this manner, a worker can access the feeding unit 2 by opening the feeding unit door 723.

That is, in step S110, the worker mounts a new feed roll R20 on the feeding shaft 20 after detaching the sheet S from the feeding shaft 20, by accessing the feeding shaft 20 of the feeding unit 2. In addition, the worker connects an end of the sheet S which is detached from the feeding shaft 20 to an end of the feed roll R20 which is newly mounted on the feeding shaft 20, and shuts the feeding unit door 723. In this manner, exchanging of the feed roll R20 which is supported by the feeding shaft 20 is completed. In the subsequent step S111, the worker performs an input denoting that exchanging of the feed roll R20 is completed to the printer control unit 200 through the monitor 210, or the operation unit 220. In addition, while the worker is executing the exchanging work of the feed roll R20, the process tension Tb at the time of completing the unlocking preparation operation is continuously applied to the sheet S of the process unit 3.

When the input denoting the completion of the roll exchanging is received from the worker, the printer control unit 200 confirms whether or not the feeding unit door 723 is shut based on a detection result for the feeding unit door sensor S723 in step S112. In addition, when the worker forgets to shut the door, and the feeding unit door 723 is open, for example (No in step S112), contents of prompting the worker to shut the feeding unit door 723 are displayed on the monitor 210 in step S113. In addition, when shutting of the feeding unit door 723 is confirmed in step S112 (Yes), step S114 is executed. In step S114, the feeding unit door 723 is locked. Subsequently, a power supply to the feeding motor M20 is started in step S115, and then the feeding motor M20 is excited in step S116. The printer control unit 200 applies the process tension Tb to the sheet S of the feeding unit 2 in this manner, and then returns to a standby state.

Hitherto, contents of steps S106 to S116 in a case of being informed of exchanging of the feed roll R20 by the worker has been described. As described above, contents of steps S106 to S116 in a case of being informed of exchanging of the windup roll R40 by the worker are the same. That is, the excitation of the winding motor M40 is cut in step S107 after executing the unlocking preparation operation in step S106, and the winding tension Tc is released. In addition, the winding unit door 743 is unlocked (step S108), and the power supply to the winding motor M40 is cut (step S109). In this manner, the roll exchanging mode is executed.

When the roll exchanging mode is completed, and access to the winding unit 4 becomes possible, the worker detaches the windup roll R40 from the winding shaft 40 in step S110, attaches the end of the sheet S which is drawn in from the process unit 3 to the winding shaft 40 in a roll shape, and shuts the winding unit door 743. Subsequently, when the worker performs an input denoting that the roll exchange is completed (step S111), the winding unit door 743 is locked after confirming the shut state of the winding unit door 743 in steps S112 and S113 (step S114). In addition, power supply to the winding motor M40 is started (step S115), and the winding motor M40 is excited (step S116). Thereafter, the printer control unit 200 returns to a standby state.

As described above, in the printer 1 according to the embodiment, the opening operation of the feeding unit door 723 which is provided in the housing member 7 of the printer 1 is regulated by the locking mechanism for feeding unit door 725. For this reason, the worker cannot open the feeding unit door 723 while the opening operation is regulated by the locking mechanism for feeding unit door 725, and can open the feeding unit door 723 while the regulation on the opening operation by the locking mechanism for feeding unit door 725 is released. In addition, releasing of the regulation on the opening operation of the feeding unit door 723 is performed after the unlocking preparation operation. Accordingly, when the feeding unit door 723 is opened by the worker, the unlocking preparation operation has been executed, and the sheet S is stopped in a state of having the process tension Tb in the process unit 3 applied. As a result, it is possible to suppress a position deviation of the sheet S in the process unit 3 during a work which is executed by the worker after the opening operation of the feeding unit door 723 (during exchanging work of feed roll R20).

In addition, in the printer 1 according to the embodiment, the opening operation of the winding unit door 743 which is provided in the housing member 7 of the printer 1 is regulated by the locking mechanism for winding unit door 745. For this reason, the worker cannot open the winding unit door 743 while the opening operation is regulated by the locking mechanism for winding unit door 745, and can open the winding unit door 743 while the regulation on the opening operation by the locking mechanism for winding unit door 745 is released. In addition, releasing of the regulation on the opening operation of the winding unit door 743 is performed after the unlocking preparation operation. Accordingly, when the winding unit door 743 is opened by the worker, the unlocking preparation operation has been executed, and the sheet S is stopped in a state of having the process tension Tb in the process unit 3 applied. As a result, it is possible to suppress a position deviation of the sheet S in the process unit 3 during a work which is executed by the worker after the opening operation of the winding unit door 743 (during exchanging work of feed roll R20).

In addition, according to the embodiment, the regulation on the opening operation of the feeding unit door 723 or the winding unit door 743 is released after releasing the tensions Ta and Tc of the sheet S which is supported by the feeding shaft 20 or the winding shaft 40. For this reason, when the worker performs the work of exchanging the sheet S, or the like, by opening the feeding unit door 723 or the winding unit door 743, since the tensions Ta and Tc of the sheet S as the work target are released in advance, it is possible for the worker to smoothly perform the work.

In addition, according to the embodiment, the opening operation of the feeding unit door 723 or the winding unit door 743 is regulated after confirming the shut state of the feeding unit door 723 or the winding unit door 743 based on a detection result of the feeding unit door sensor S723, or the winding unit door sensor S743. In this manner, it is possible to avoid a situation in which the opening operation of the door 723 or 743 is regulated before the feeding unit door 723 or the winding unit door 743 is shut, and it is possible to appropriately regulate the opening operation of the door 723 or 743 after the feeding unit door 723 or the winding unit door 743 is shut.

In addition, according to the embodiment, the sheet S which is supported by the feeding shaft 20 or the winding shaft 40 has the tension applied, after the opening operation of the feeding unit door 723 or the winding unit door 743 is regulated. With such a configuration, it is possible to avoid a situation in which the tensions Ta and Tc are applied to the sheet S which is supported by the feeding shaft 20 or the winding shaft 40 during a work of a worker by mistake, and the work of the worker is disturbed.

In addition, according to the embodiment, the monitor 210, or the operation unit 220 which receives an input (instruction of executing roll exchanging mode) denoting that a work accompanied by the opening operation of the feeding unit door 723 or the winding unit door 743 (in example according to the embodiment, exchange work of rolls R20 and R40) is to be executed is provided. In addition, when there is the input through the interface thereof, the regulation on the opening operation of the feeding unit door 723 or the winding unit door 743 is released after the unlocking preparation operation is executed. In such a configuration, it is possible to release the regulation on the opening operation of the feeding unit door 723 or the winding unit door 743 by performing the unlocking preparation operation at a timing corresponding to the work of the worker. For this reason, workability of the worker is improved.

As described above, according to the embodiment, the printer 1 corresponds to an example of the "image forming apparatus" of the invention, the sheet S corresponds to an example of the "recording medium" in the invention, the front driving roller 31 corresponds to an example of the "first roller" or the "second roller" of the invention, the rear driving roller 32 corresponds to an example of the "second roller" or the "first roller" of the invention, the process unit 3 corresponds to an example of the "image forming region" of the invention, the housing member 7 corresponds to an example of the "external member" of the invention, the feeding unit door 723 or the winding unit door 743 corresponds to an example of the "opening-shutting door" of the invention, the locking mechanism for feeding unit door 725 or the locking mechanism for winding unit door 745 corresponds to an example of the "opening-shutting regulation unit" of the invention, the printer control unit 200 corresponds to an example of the "control unit" of the invention, the unlocking preparation operation corresponds to an example of the "preparation operation for releasing regulation" of the invention, the feeding shaft 20 or the winding shaft 40 corresponds to the "rotational shaft" of the invention, the feeding motor M20 or the winding motor M40 corresponds to the "motor" of the invention, the feeding unit door sensor S723 or the winding unit door sensor S743 corresponds to the "opening-shutting detection unit" of the invention, and the monitor 210 and the operation unit 220 function as an example of the "input unit" of the invention in collaboration.

In addition, the invention is not limited to the above described embodiment, and it is possible to add various modifications to the above described embodiment without departing from the scope of the invention. For example, in the embodiment, a case has been exemplified in which the invention is applied to the printer 1 in which the sheet S is transported by controlling a torque of the rear driving roller 32, while controlling a rotation speed of the front driving roller 31, in the image forming mode. However, it is also possible to apply the invention to the printer 1 in which the sheet S is transported by controlling a rotation speed of the rear driving roller 32, while controlling a torque of the front driving roller 31, in the image forming mode.

In addition, the printer 1 according to the embodiment is configured so that a worker specifies a roll to be exchanged between the rolls R20 and R40, and instructs the printer control unit 200 to execute the roll exchanging mode. However, it is also possible to configure the printer 1 so that a worker instructs the printer control unit 200 to execute the roll exchanging mode without specifying a roll to be exchanged. In this case, the printer may be configured so that a worker can exchange either the roll R20 or R40 by executing the roll exchanging mode in steps S106 to S109 in both of the feeding unit 2 and the winding unit 4.

In addition, according to the embodiment, a case in which the unlocking preparation operation is executed from a standby state is exemplified. However, an execution timing of the unlocking preparation operation is not limited to this. Accordingly, it is also possible to configure so that the unlocking preparation operation can be executed in the middle of executing the image forming mode, or the like, for example.

In addition, according to the embodiment, a transmission of power from the feeding motor M20 to the feeding shaft 20 is stopped by cutting the excitation of the feeding motor M20. However, a specific configuration of executing the stopping of the power transmission from the feeding motor M20 to the feeding shaft 20 is not limited to this. For example, the power transmission may be stopped by disconnecting a clutch which transmits power from the feeding motor M20 to the feeding shaft 20. In addition, it is possible to adopt a configuration in which a power transmission between the winding motor M40 and the winding shaft 40 is performed in the same manner.

In addition, a door other than the feeding unit door 723 or the winding unit door 743 may be provided in the housing member 7, and specifically, a process unit door for opening-shutting the process unit 3 may be separately provided. In this case, a configuration may be adopted in which a locking mechanism is also provided with respect to the process unit door in the process unit 3 by imitating the above described embodiment, and unlocking of the locking mechanism of the process unit door is performed after the unlocking preparation operation.

The entire disclosure of Japanese Patent Application No. 2013-058069, filed Mar. 21, 2013 is expressly incorporated by reference herein.

What is claimed is:

1. An image forming apparatus comprising:

a first roller;

a second roller on which a recording medium is stretched between the first roller and the second roller;

a head which performs image forming on the recording medium in an image forming region between the first roller and the second roller;

an external member which covers an inside of the apparatus;

an opening-shutting door which is provided in the external member;

an opening-shutting regulation unit which regulates an opening operation of the opening-shutting door; and a control unit which transports the recording medium while applying a tension to the recording medium in the image forming region by controlling rotations of the first and second rollers, and regulates the opening operation of the opening-shutting door by the opening-shutting regulation unit while the head is performing the image forming, wherein the control unit releases a regulation of the opening operation of the opening-shutting door by the opening-shutting regulation unit after performing a preparation operation for releasing the regulation which stops the recording medium in a state in which the tension is applied to the recording medium in the image forming region by controlling the rotations of the first and second rollers.

2. The image forming apparatus according to claim 1, further comprising:

a rotational shaft which supplies the recording medium to the image forming region, or collects the recording medium from the image forming region by rotating, while detachably supporting the recording medium, wherein the opening-shutting door is provided so as to face the rotational shaft.

3. The image forming apparatus according to claim 2, wherein the control unit releases the regulation of the opening operation of the opening-shutting door by the opening-shutting regulation unit after releasing the tension of the recording medium which is supported by the rotational shaft.

4. The image forming apparatus according to claim 3, further comprising:

a motor which drives the rotational shaft, wherein the control unit releases the tension of the recording medium which is supported by the rotational shaft by stopping a transmission of power to the rotational shaft from the motor.

5. The image forming apparatus according to claim 3, further comprising:

an opening-shutting detection unit which detects opening or shutting of the opening-shutting door, wherein the control unit regulates the opening operation of the opening-shutting door by the opening-shutting regulation unit after confirming a shut state of the opening-shutting door based on a detection result of the opening-shutting detection unit.

6. The image forming apparatus according to claim 5, wherein the control unit applies the tension to the recording medium which is supported by the rotational shaft, after regulating the opening operation of the opening-shutting door by the opening-shutting regulation unit.

7. The image forming apparatus according to claim 1, further comprising:

an input unit which receives an input from a worker, wherein the control unit releases the regulation of the opening operation of the opening-shutting door by the opening-shutting regulation unit after performing the preparation operation for releasing the regulation, when there is an input denoting that a work accompanied by the opening operation of the opening-shutting door is to be executed, in the input unit.

8. A method of controlling a tension of a recording medium in an image forming apparatus which performs image forming on a recording medium in an image forming region, and includes an opening-shutting door in an external member, the method comprising:

transporting the recording medium while applying a tension to the recording medium in the image forming region, and regulating an opening operation of the opening-shutting door while the image forming is performed; and releasing the regulation of the opening operation of the opening-shutting door, after performing a preparation operation for releasing the regulation which stops the recording medium in a state in which the tension is applied to the recording medium in the image forming region.

* * * * *